US009240157B2

(12) United States Patent
Hsu et al.

(10) Patent No.: US 9,240,157 B2
(45) Date of Patent: Jan. 19, 2016

(54) TIMING CONTROLLER, SOURCE DRIVING DEVICE, PANEL DRIVING DEVICE, DISPLAY DEVICE AND DRIVING METHOD FOR REDUCING POWER CONSUMPTION THROUGH REDUCING STANDBY DURATIONS

(75) Inventors: Chin-Hung Hsu, Tao-Yuan Hsien (TW); Yu-Ming Chang, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 668 days.

(21) Appl. No.: 13/093,848

(22) Filed: Apr. 26, 2011

(65) Prior Publication Data

US 2012/0154356 A1 Jun. 21, 2012

(30) Foreign Application Priority Data

Dec. 17, 2010 (TW) ..... 99144411 A

(51) Int. Cl.

*G09G 3/34* (2006.01)
*G09G 3/36* (2006.01)
*G09G 5/00* (2006.01)

(52) U.S. Cl.

CPC ..... *G09G 3/3688* (2013.01); *G09G 2310/0264* (2013.01); *G09G 2330/021* (2013.01); *G09G 2370/08* (2013.01); *G09G 2370/14* (2013.01)

(58) Field of Classification Search

CPC ..... G09G 3/3688
USPC ..... 345/204, 100
See application file for complete search history.

(56) References Cited

U.S. PATENT DOCUMENTS

| | | | | |
|---|---|---|---|---|
| 2003/0038771 | A1 | 2/2003 | Sunohara | |
| 2007/0216630 | A1* | 9/2007 | Liao | 345/100 |
| 2007/0273632 | A1* | 11/2007 | Kishimoto et al. | 345/98 |
| 2008/0158206 | A1 | 7/2008 | Ishikawa | |
| 2009/0096775 | A1* | 4/2009 | Lin et al. | 345/213 |
| 2009/0309860 | A1* | 12/2009 | Hsu et al. | 345/211 |
| 2011/0032421 | A1* | 2/2011 | Kota | 348/500 |
| 2011/0063270 | A1* | 3/2011 | Minami | 345/208 |

FOREIGN PATENT DOCUMENTS

| | | | | |
|---|---|---|---|---|
| CN | 1917026 A | 2/2007 | | |
| CN | 101572047 A | 11/2009 | | |
| JP | 2006227104 A * | 8/2006 | | G09G 3/36 |

* cited by examiner

*Primary Examiner* — Adam J Snyder
(74) *Attorney, Agent, or Firm* — Winston Hsu; Scott Margo

(57) ABSTRACT

A source driving device, capable of reducing stand-by period and saving power consumption, includes a plurality of source drivers connected in series, which include one or more cascade source drivers. The one or more cascade source drivers include one or more first-type cascade source drivers, each of which, at different times to other first-type cascade source drivers, is respectively activated by a pulse signal generated by a previous source driver, and after the activation, is triggered by a frame signal to receive corresponding frame data in the frame signal. Each of the source drivers generates a pulse signal after receiving the corresponding frame data to activate the next source driver.

25 Claims, 12 Drawing Sheets

TIMING CONTROLLER, SOURCE DRIVING DEVICE, PANEL DRIVING DEVICE, DISPLAY DEVICE AND DRIVING METHOD FOR REDUCING POWER CONSUMPTION THROUGH REDUCING STANDBY DURATIONS

BACKGROUND OF THE INVENTION

1. Field of the Invention

The present invention is related to a driving method, driving device and cascade source drivers for a LCD panel, and more particularly, to a driving method, driving device and cascade source drivers reducing power consumption of the LCD panel through reducing standby durations of receivers within the driving device.

2. Description of the Prior Art

With advances in resolution of a liquid crystal display (LCD), throughput between a timing controller and source drivers of a panel driving device rapidly increases, resulting in sides effects of numerous pins, additional power consumption, electromagnetic interference (EMI), etc. Thus, reduced swing differential interfaces, such as a reduced swing differential signaling (RSDS) and a mini low-voltage differential signaling (mini-LVDS), are proposed to overcome those side effects.

Please refer to FIG. 1, which is a schematic diagram of a mini-LVDS interface 100 of a conventional panel driving device. The mini-LVDS interface 100 includes a timing controller 110 and four representative source drivers 120_1-120_4 connected in series. The source drivers 120_1-120_4 respectively include receivers 130_1-130_4, converters 140_1-140_4 and transmitters 150_1-150_4.

The timing controller 110 is arranged to generate a frame signal FRM utilized for providing frame data to the source drivers 120_1-120_4. Meanwhile, the timing controller 110 further generates a system timing generation signal SYS utilized for controlling operation timings of the source drivers 120_1-120_4. The receivers 130_1-130_4 sequentially receive corresponding frame data from the frame signal FRM. The converters 140_1-140_4 respectively convert the frame data into source driving signals VS_1-VS_4. The transmitters 150_1-150_4 respectively transmit the source driving signals VS_1-VS_4 to pixel units of a LCD panel. In addition, after the receivers 130_1-130_3 complete receiving the frame data, the transmitters 150_1-150_3 respectively transmit impulse signals SP1-SP3 to the receivers 130_2-130_4 to trigger the receivers 130_2-130_4 to start the reception.

FIG. 2 is a timing diagram of signals of the mini-LVDS interface 100. Note that, the frame signal FRM includes three representative differential signals LV1, LV2, LV3 simultaneously provided to the receivers 130_1-130_4 of the source drivers 120_1-120_4. Each of the differential signals LV1, LV2, LV3 includes plural data sections DATA separated by blank sections BLK. In addition, at least one of the differential signals, e.g. the differential signal LV1, further includes reset indication sections RST, each arranged to be right after the blank section BLK synchronized with the system timing generation signal SYS, and utilized for synchronizing reception timings of the receivers 130_1-130_4 after the source drivers 120_1-120_4 are activated.

FIG. 3 is a schematic diagram of a driving process 30 of the mini-LVDS interface 100. Please simultaneously refer to from FIG. 1 to FIG. 3 to understand overall operation of the mini-LVDS interface 100. First, since the driving process 30 starts (Step 300), the timing controller 110 generates the frame signal FRM according to the system timing generation signal SYS (Step 302). Next, the source drivers 120_1-120_4 are activated to a standby state after the receivers 130_1-130_4 receives a rising impulse edge of the system timing generation signal SYS (Step 304). Later, the receivers 130_1-130_4 receive the reset indication section RST to synchronize the reception timings through activating internal reception clocks thereof (Step 306).

Since an impulse signal SP is fixed at a high level, the receiver 130_1 starts receiving the data section DATA after it receives reset indication section RST (Step 308). However, the other source drivers 120_2-120_4 remain standby since the corresponding impulses SP1, SP2, SP3 are disabled.

After the receiver 130_1 finishes the reception, the transmitter 150_1 outputs the impulse signal SP1 (Step 310) to trigger the receiver 130_2 of the next source driver 120_2 to start receiving data (Step 312). Similarly, the transmitter 150_2 outputs the impulse signal SP2 after the receiver 130_2 finishes the reception (Step 332) to trigger the next receiver 130_3 to receive data (Step 313). The transmitter 150_3 generates the impulse signal SP3 after the receiver 130_3 finishes the reception (Step 333) to trigger the next receiver 130_4 to start receiving data (Step 314), so as to complete overall data reception of an updating cycle.

At the next rising impulse edge of the system timing generation signal SYS, the converters 140_1-140_4 of the source drivers 120_1-120_4 simultaneously convert the received data section DATA into the source driving signals VS_1-VS_4 (Step 340). Finally, at a falling impulse edge of the system timing generation signal SYS, the transmitters 150_1-150_4 of the source drivers 120_1-120_4 transmit the source driving signals VS_1-VS_4 to pixel units of the LCD panel (Step 350), and the driving process 30 ends (Step 360).

To sum up, when receiving corresponding data section from the frame signal FRM, the source drivers 120_1-120_4 have to be respectively triggered by the impulse signals SP0-SP3 to start receiving data. Other than the impulse signal SP0 fixed at the high level, the impulse signals SP1-SP3 are generated respectively after the receivers 130_1-130_3 finish the reception. As a result, the receivers 130_1-130_4 sequentially receive the corresponding frame data at different times.

However, in the driving process 30, the receivers 130_2-130_4 are activated by the system timing generation signal SYS at time t1, but do not function until respectively triggered by the impulse signals SP1, SP2, SP3 at time t2, t3, t4, which are determined based on when the previous source drivers finish the reception. That is, in standby durations P2, P3, P4, the receivers 130_2-130_4 dissipate power without performing any functions. Therefore, the conventional driving process 30 has to be improved.

SUMMARY OF THE INVENTION

It is therefore a primary objective of the claimed invention to provide a source driving device, a panel driving device, a display apparatus, a timing controller and a driving method capable of reducing standby durations to save power consumption.

In a first aspect, a source driving device is disclosed, comprising a plurality of source drivers, connected in series, comprising one or more cascade source drivers, comprising one or more first-type cascade source drivers. Each of the one or more first-type cascade source drivers is activated by a pulse signal generated by a previous source driver respectively at different times from other first-type cascade source drivers, and after the activation, is triggered by a frame signal to receive corresponding frame data from the frame signal. Each of the source drivers other than the last source driver generates a pulse signal after receiving the corresponding frame data to activate the next source driver.

In a second aspect, a panel driving device is also disclosed, comprising the above source driving device, and a timing controller, coupled to the source driving device for generating the frame signal sent to the plurality of source drivers of the source driving device, to drive the source drivers to generate a plurality of source driving signals.

In a third aspect, a display apparatus is further provided, comprising the above-mentioned panel driving device, and a panel for receiving driving signals from the panel driving device to display a frame.

In a fourth aspect, a timing controller is provided, comprising a system timing generation portion for generating a system timing generation signal, and a frame signal generation portion for generating a frame signal synchronized with the system timing generation signal and comprising frame data corresponding to a plurality of source drivers, and sequentially triggering one or more cascade source drivers of the plurality of source drivers to receive corresponding frame data at different times.

In a fifth aspect, a driving method for a display apparatus is provided. The display apparatus comprises a plurality of source drivers connected in series. The plurality of source drivers comprise one or more first-type cascade source drivers. The driving method comprises utilizing a frame signal to sequentially activate the one or more first-type cascade source drivers to respectively receive corresponding frame data from the frame signal at different times, and after the source driver receives the corresponding frame data, utilizing each of the source drivers other than the last source driver to generate a pulse signal to activate the next source driver.

These and other objectives of the present invention will no doubt become obvious to those of ordinary skill in the art after reading the following detailed description of the preferred embodiment that is illustrated in the various figures and drawings.

DETAILED DESCRIPTION

In the disclosed source driving technique, cascade source drivers are one by one activated to a standby state at different times instead of all activated at the same time. Additionally, the cascade source drivers can immediately start receiving frame data after the activation. As a result, a standby duration between the activation and the reception is significantly reduced to overcome the power consumption problem caused by long standby durations of the cascade source drivers in the prior art.

Several embodiments featuring modifications of activation and triggering conditions of the cascade source drivers are described below. In addition, sections for controlling the activation are inserted into the frame signal. As a result, only after previous source drivers finish receiving data, the cascade source drivers are activated by previous source drivers to the standby state, and only after the activation, the cascade source drivers are triggered by the frame signal right to start receiving data.

Figure 4:
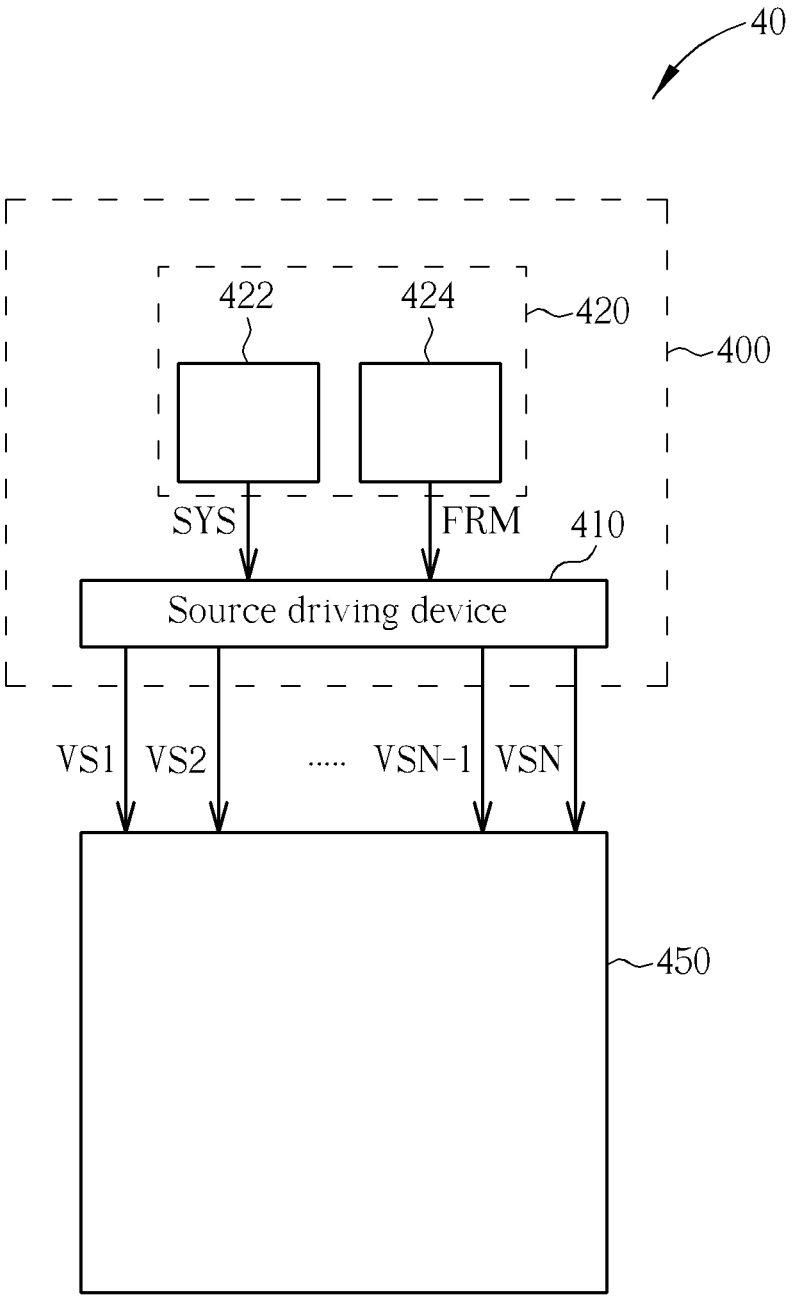
FIG. 4 is a schematic diagram of a display apparatus according to an embodiment.
Figure 5:
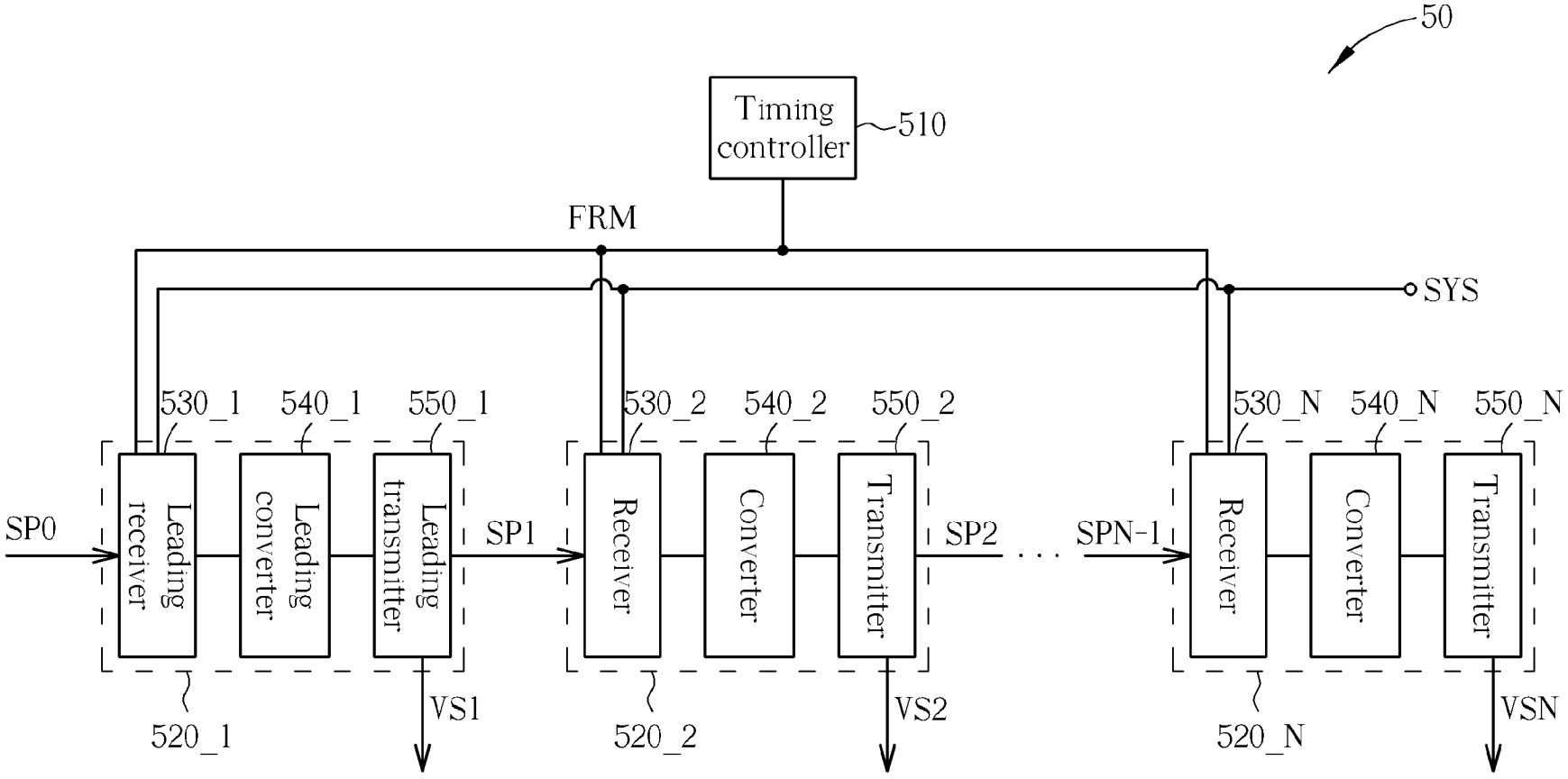
FIG. 5 is a schematic diagram of an embodiment of a source driving device of the display apparatus shown in FIG. 4.

Please simultaneously refer to FIG. 4 and FIG. 5. FIG. 4 is a schematic diagram of a display apparatus 40 according to an embodiment, and FIG. 5 is a schematic diagram of an embodiment of a source driving device 410 shown in FIG. 4. In FIG. 5, the display apparatus 40 includes a panel driving device 400 and a panel 450. The panel driving device 400 includes a timing controller 420 and the source driving device 410. The timing controller 420 includes a system timing generation portion 422 and a frame signal generation portion 424 respectively utilized for generating a system timing generation signal SYS and a frame signal FRM synchronized with the system timing generation signal SYS. The system timing generation signal SYS is utilized for controlling operation timing of the source driver device 410, and the frame signal FRM is utilized for carrying the frame data and triggering the reception of the source driving device 410.

Transmission between the timing controller 420 and the source driving device 410 preferably conforms to a mini low-voltage differential signaling (mini-LVDS) interface to reduce employed pins, power consumption and electromagnetic interference (EMI). Certainly, the novelty of the one by one activation for the cascade source drivers can be applied to other source driving devices with source drivers connected in series, and is not limited to the mini-LVDS interface.

Please refer to FIG. 5, which is a schematic diagram of an embodiment of the source driving device 410. In FIG. 5, the source driving device 410 includes a leading source driver 520_1 and first-type cascade source drivers 520_2-520_N (N is a positive integer). The source drivers 520_1-520_N are respectively utilized for generating source driving signals VS1-VSN required by the panel 450 according to the system timing generation signal SYS and the frame signal FRM. In detail, in each of the source drivers 520_1-520_N, receivers 530_1-530_N are arranged to receive corresponding frame data from the frame signal FRM, converters 540_1-540_N are arranged to convert the received frame data into the source driving signals VS1-VSN, and transmitters 550_1-150_N are arranged to transmit the source driving signals VS1-VSN to corresponding pixel units of the panel 450. In addition, when the receivers 530_1-530_N−1 finish receiving data, the source drivers 520_1-520_N−1 (e.g. the transmitters 550_1-550_N−1 or the receivers 530_1-530_N−1) respectively transmit impulse signals SP1-SPN−1 to next receivers 530_2-530_N.

In detail, the leading source driver 520_1 is activated to the standby state according to the system timing generation signal SYS, and starts receiving corresponding frame data from the frame signal FRM after triggered by the frame signal FRM. Differently, the first-type cascade source drivers 520_2-520_N are activated to the standby state by the impulse signals SP1-SP_N−1 sent by previous source drivers, and are triggered one by one by the frame signal FRM to sequentially receive corresponding frame data from the frame signal FRM at different times. In addition, other than the last first-type cascade source driver 520_N, the source drivers 520_1-520_N−1 respectively output the impulse signals SP1-SP_N−1 to next source drivers after finishing receiving the corresponding frame data. When all the source drivers 520_1-520_N complete the data reception, the system timing generation signal SYS further triggers the source drivers 520_1-520_N to convert the received frame data into the source driving signals VS1-VSN and output the source driving signals VS1-VSN. As a result, the panel 450 can update pixel contents to display a frame.

Figure 1:
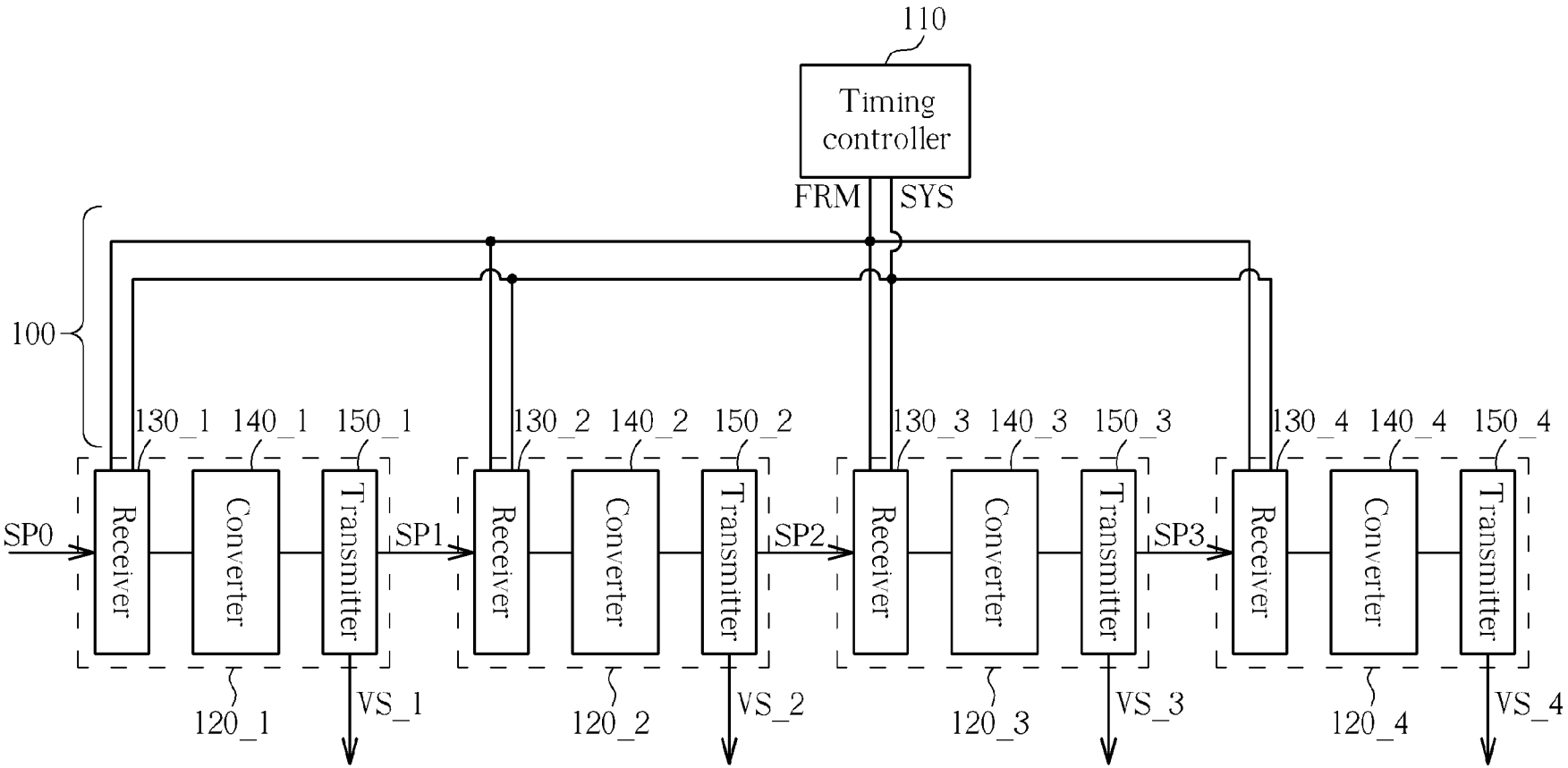
FIG. 1 PRIOR ART
FIG. 1 is a schematic diagram of a mini-LVDS interface of the prior art.
Figure 3:
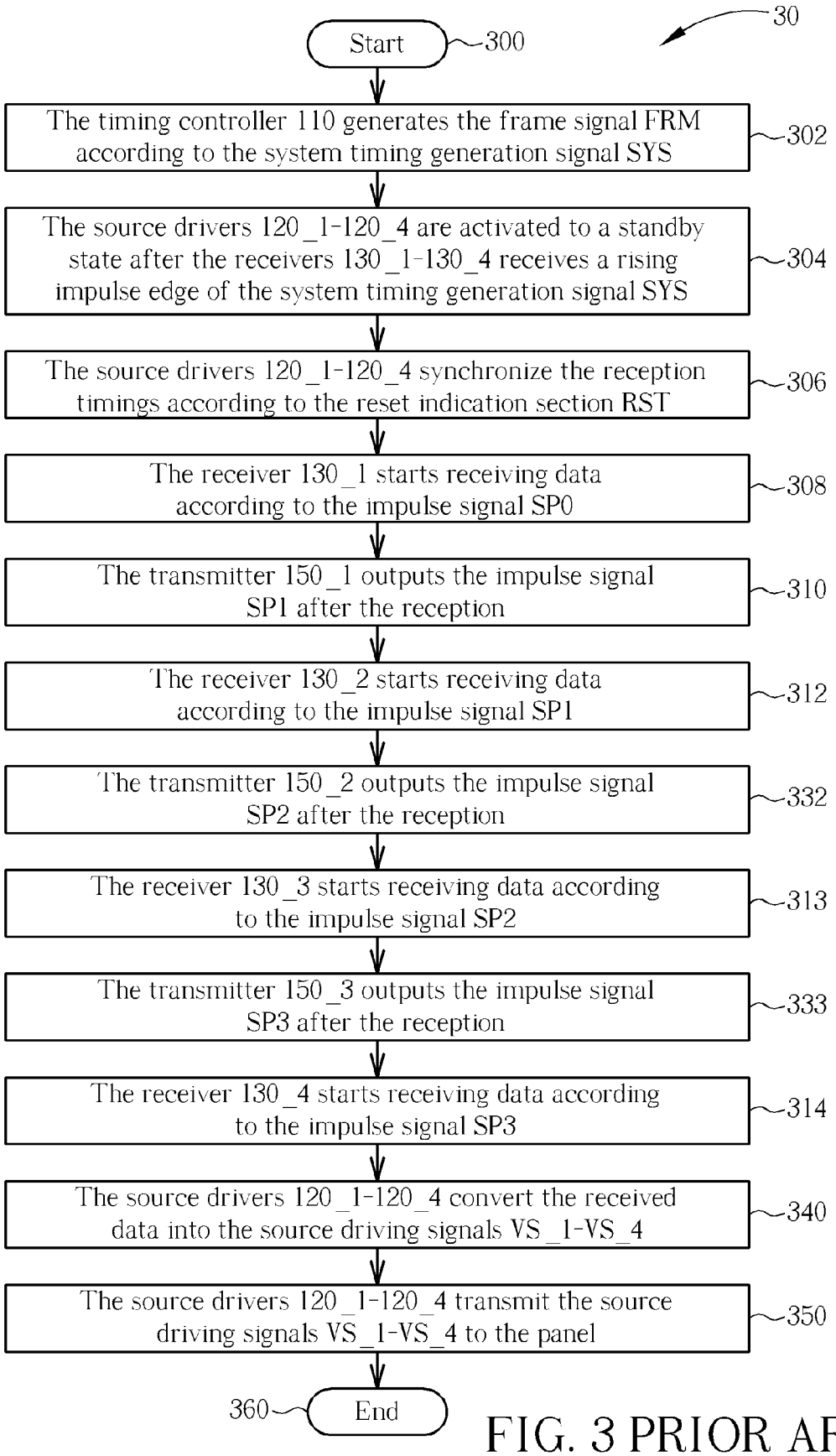
FIG. 3 PRIOR ART
FIG. 3 is a schematic diagram of a driving process of the mini-LVDS interface shown in FIG. 1.

In other words, the main difference between the present embodiment and the prior art presented in FIG. 1 and FIG. 3 lies in that triggering conditions for the first-type cascade source drivers 520_2-520_N and the source drivers 120_2-120_4 are different. More specifically, as to the activation condition, the first-type cascade source drivers 520_2-520_N are no longer activated by the system timing generation signal SYS at the same time, but are activated, one by one, by impulse signals sent by previous source drivers when the previous drivers finish data reception. That is, the impulse signals are no longer utilized for triggering data reception, but are utilized for activating the source drivers. As to the triggering conditions, the data reception of each the first-type cascade source drivers 520_2-520_N is triggered by the frame signal FRM instead of a previous source driver right after activated to the standby state. With this triggering condition modification, each source driver is activated right before its data reception to reduce power dissipated in the standby duration.

To follow such a modification of the triggering condition, the frame signal FRM does not only provide the frame data to the source drivers 520_1-520_N, but sequentially triggers the source drivers 520_1-520_N as well, such that the source drivers 520_1-520_N are activated and then receive corresponding frame data at different times. In short, the frame signal FRM generated by the timing controller 420 differs from the prior art presented in FIG. 2 in that the frame signal FRM is further utilized for sequentially triggering the first-type cascade source drivers 520_2-520_N.

Figure 6A:
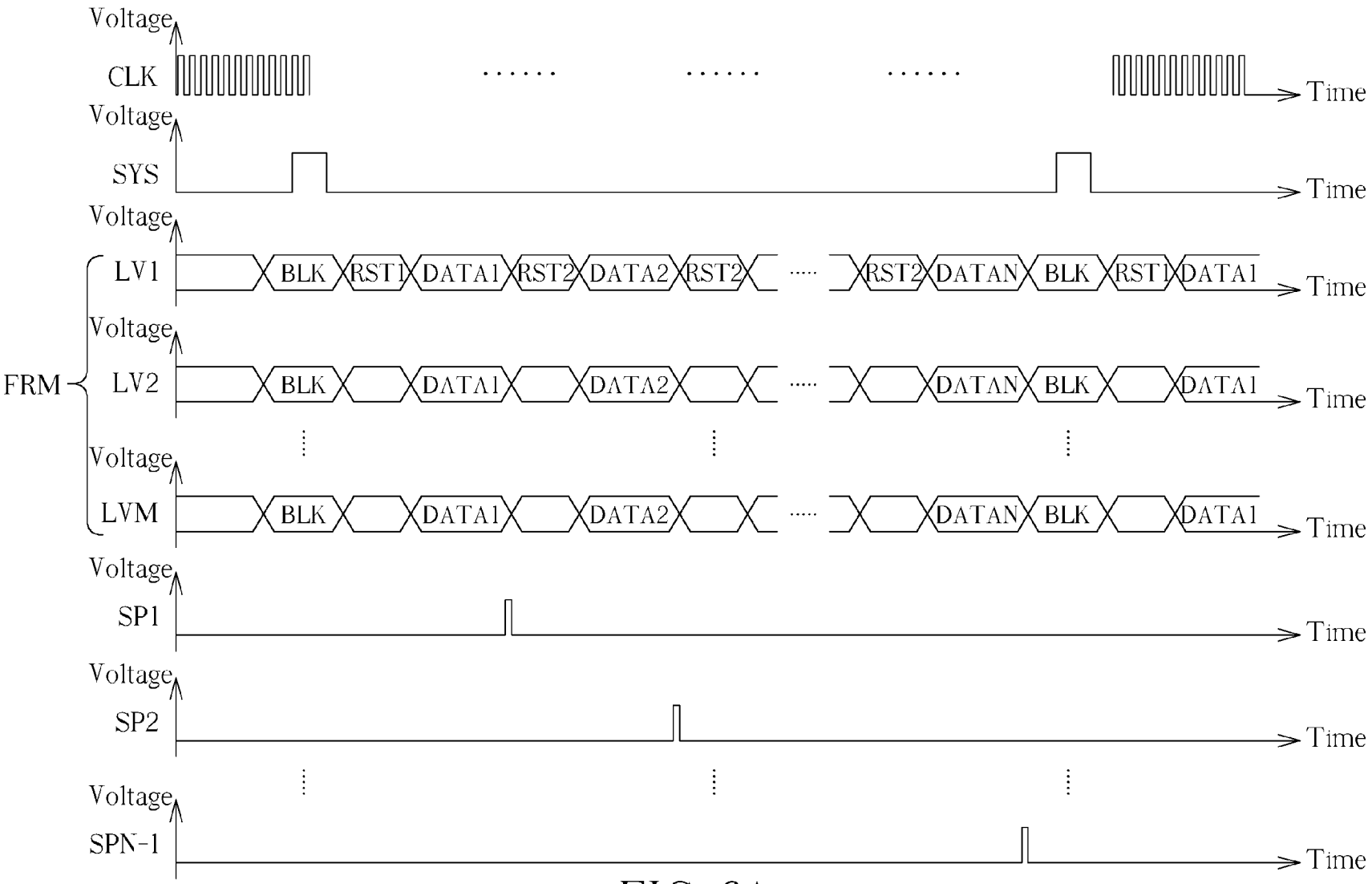
FIG. 6A is a timing diagram of an embodiment of typical signals of the source driving device shown in FIG. 5.

Please refer to FIG. 6A, which is a timing diagram of an embodiment of a clock signal CLK, the system timing generation signal SYS, the frame signal FRM and the impulse signals SP1-SP_N−1 of the source driving device 410. In FIG. 6A, the system timing generation signal SYS includes plural impulses which first activate the leading source driver 520_1. The frame signal FRM includes M differential signals LV1-LVM (M is a positive integer). During each scanning period specified by two adjacent impulses of the system timing generation signal SYS, the differential signals LV1-LVM includes data sections DATA1-DATAN respectively corresponding to the source drivers 520_2-520_N. At least one of the differential signals LV1-LVM, e.g. the differential signal LV1 in FIG. 6A, is inserted with second-type reset indication sections RST2 respectively located prior to the data sections DATA2-DATAN and utilized for triggering the first-type cascade source drivers 520_2-520_N to receive the corresponding data sections DATA2-DATAN. In addition, at least one of the differential signals LV1-LVM, e.g. the differential signal LV1 in FIG. 6A, is inserted with a first-type reset indication section RST1 located prior to the data section DATA1 and utilized for triggering the leading source driver 520_1 to receive the corresponding data section DATA1.

Figure 2:
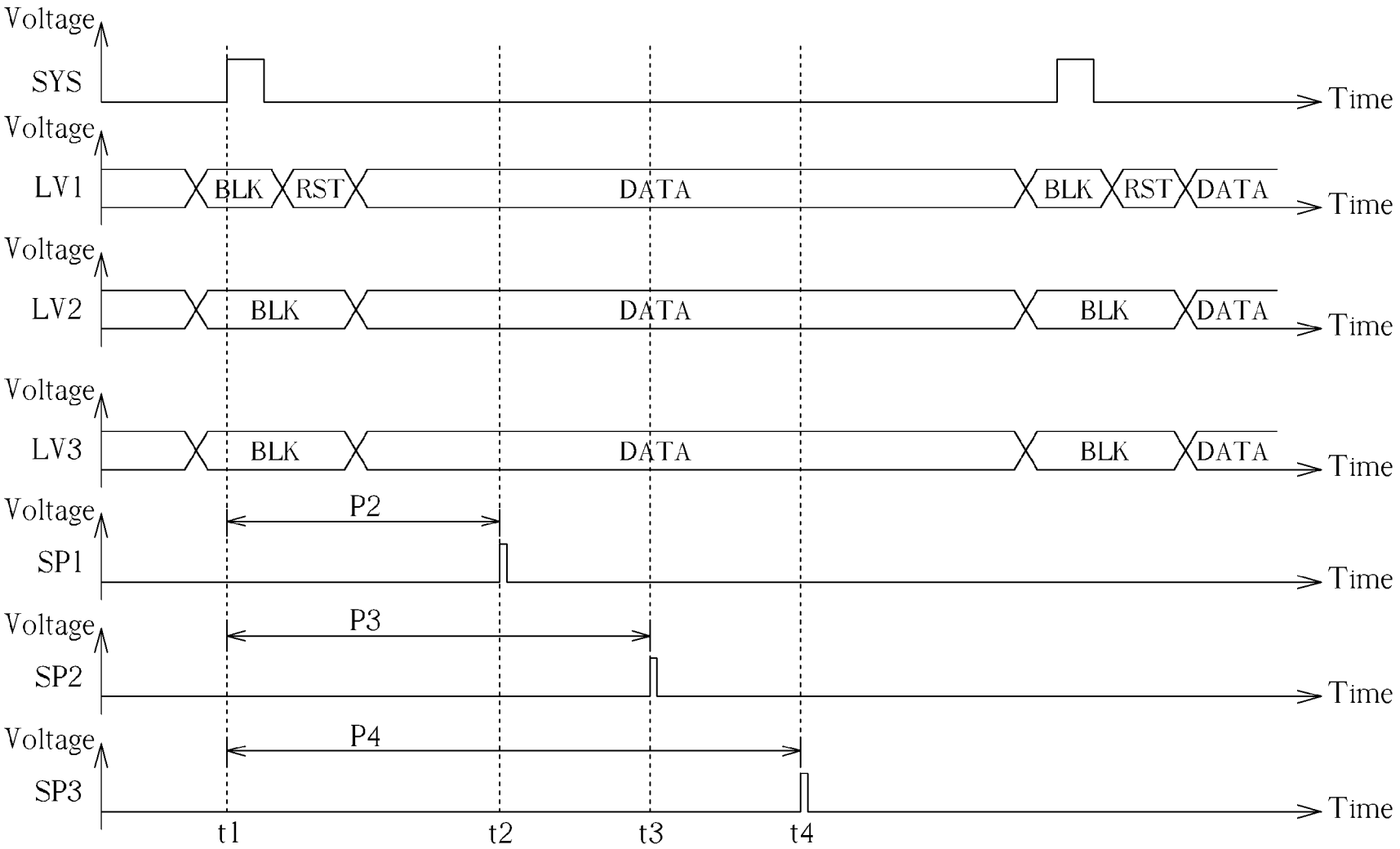
FIG. 2 PRIOR ART
FIG. 2 is a timing diagram of signals of the mini-LVDS interface shown in FIG. 1.

Compared with the timing diagram presented in FIG. 2, the frame signal FRM of FIG. 6A further includes plural second-type reset indication sections RST2 between two adjacent blank sections BLK. The second-type reset indication sections RST2, dividing the continuous data section DATA presented in FIG. 2 into the plural data sections DATA2-DATAN, can sequentially trigger the first-type cascade source drivers 520_2-520_N to receive the corresponding data sections DATA2-DATAN at different times. Preferably, each of the impulse signals SP1-SP_N−1 is arranged to be closely prior to the second-type reset indication section RST2 to guarantee a short time interval between activation and reception operations of each of the first-type cascade source drivers 520_2-520_N. As a result, the power dissipated during the standby durations can be significantly reduced in comparison with the prior art.

Note that, the timing diagram of FIG. 6A merely illustrates one preferred embodiment, and can be modified and varied as long as the first-type cascade source drivers 520_2-520_N are sequentially activated. In addition, contents of the first-type reset indication section RST1 and the second-type reset indication sections RST2 are preferably identical to simplify overall design, but can distinct based on different application requirements. Also, contents of the second-type reset indication sections RST2 at different positions can be variant.

Figure 6B:
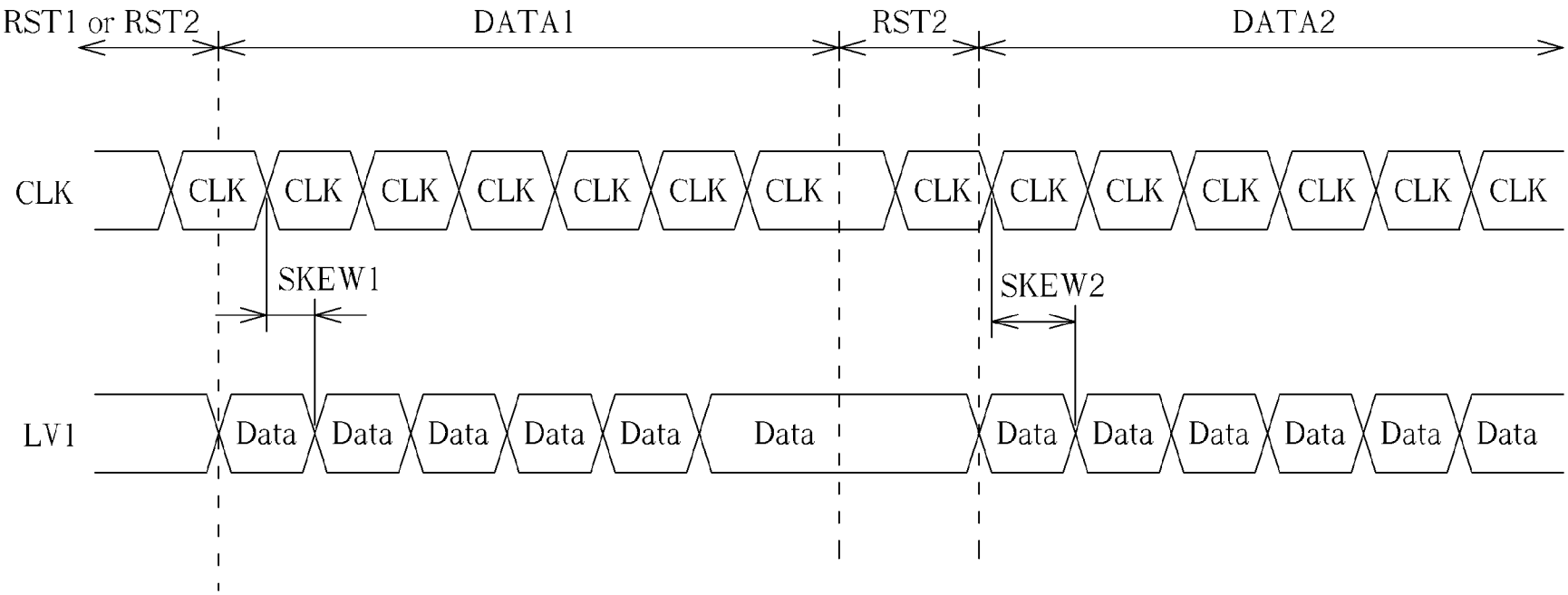
FIG. 6B is a timing diagram of a frame signal and a clock signal shown in FIG. 6A.

Please refer to FIG. 6B, which is a zoomed-out timing diagram of the clock signal CLK and the frame signal FRM in according to FIG. 6A. Both the clock signal CLK and the frame signal FRM are generated by the timing controller 510. Note that, time skews exist between the clock signal CLK and data sections DATA of each of the differential signals (e.g. LV1 in FIG. 6B) of the frame signal FRM, and can be adjusted based on different design requirements to optimize display quality. In addition, time skews SKEW1-SKEWN of the source drivers 520_1-520_N (only SKEW1, SKEW2 are plotted in FIG. 6B) can be identical or distinct.

To implement such an adjustment, the timing controller 510 can be differently configured in comparison with the prior art. For example, whole or a portion of the second-type reset indication sections can be replaced by the black sections BLANK to adjust the time skews between the clock signals CLK and the data sections DATA. The time skews between different source drivers also can be different. Note that, regardless of whether a conventional source driver (e.g. the leading source driver or a second-type cascade source driver described below) or the first-type cascade source driver is employed, the timing controller 510 can be arranged to adjust time skews for different source drivers to optimize the display quality.

Figure 6C:
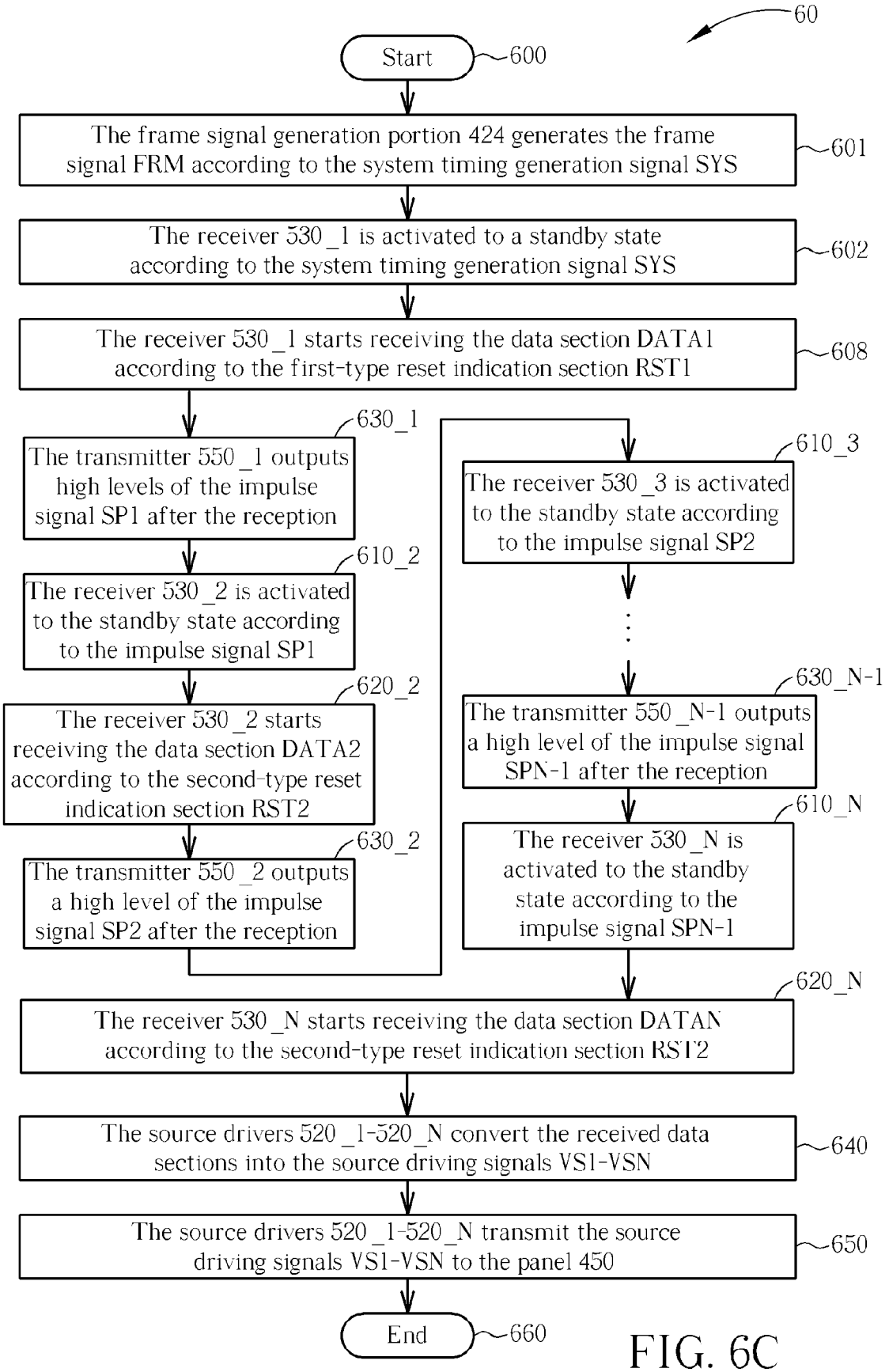
FIG. 6C is a schematic diagram of an embodiment of a driving process of the source driving device shown in FIG. 5.

FIG. 6C is a schematic diagram of a driving process 60 of the source driving device 410 according to operation timing illustrated in FIG. 6A. Please simultaneously refer to FIG. 4-FIG. 6A and FIG. 6C to understand operations of the source driving device 410. First, after the driving process 60 starts (Step 600), the frame signal generation portion 424 generates the frame signal FRM according to the system timing generation signal SYS generated by the system timing generation portion 422 (Step 601).

Next, the receiver 530_1 of the leading source driver 520_1 is activated to a standby state after receiving an impulse rising edge of the system timing generation signal SYS (Step 602). Later, since the impulse signal SP0 is at the high level, the receiver 530_1 starts receiving the data section DATA1 after an internal reception clock is activated since the receiver 530_1 receives the first-type reset indication section RST1 (Step 608). However, the other first-type cascade source drivers 520_2-520_N are still not activated.

Next, after finishing the data reception, the transmitter 550_1 outputs high levels of the impulse signal SP1 (Step 630_1), and therefore the receiver 530_2 of the next source driver 520_2 is activated to the standby state (Step 610_2). After entering the standby state, the receiver 530_2 can be immediately triggered by the second-type reset indication section RST2 to start receiving the data section DATA2 (Step 620_2), and then the transmitter 550_2 outputs a high level of the impulse signal SP2 after finishing the data reception (Step 630_2).

Similarly, the receivers 530_3-530_N of the remaining first-type cascade source drivers 520_3-520_N are sequentially activated by the impulse signals SP2-SPN−1 after previous source drivers complete respective data reception (Step 610_3 to Step 610_N). And after the activation, they are immediately triggered by the second-type reset indication sections RST2 to start receiving the data sections DATA3-DATAN (Step 620_3 to Step 620_N). Other than the last first-type cascade source driver 520_N, all the first-type cascade source drivers 520_3-520_N−1 respectively output high levels of the impulse signals SP3-SPN−1 after finishing the data reception (Step 630_3 to Step 630_N−1).

At the next rising impulse edge of the system timing generation signal SYS, the converters 540_1-540_N of the source drivers 520_1-520_N simultaneously convert the received data sections into the source driving signals VS1-VSN (Step 640). Finally, at the next falling impulse edge of the system timing generation signal SYS, the transmitters 550_1-550_N of the source drivers 520_1-520_N transmit the source driving signals VS1-VSN to corresponding pixel units of the panel 450 (Step 650), and the driving process 60 ends (Step 660).

To sum up, each of the first-type cascade source drivers 520_2-520_N can be activated to the standby state only when the previous source driver finishes the data reception, and can be immediately triggered by the second-type reset indication section RST2 of the frame signal FRM to start receiving data. As a result, the standby duration of the first-type cascade source drivers 520_2-520_N can be significantly reduced.

Note that, one or more of the first-type cascade source drivers 520_2-520_N can be replaced by second-type cascade source drivers to group the source drivers and further reduce the number of the second-type reset indication sections RST2. The fist-type and second-type cascade source drivers are not limited in number, and can be serially connected in any order to meet various application requirements. Operations of the second-type cascades source drivers are similar to the leading source driver 520_1, and can be summarized as:

Enter the standby state according to the system timing generation signal SYS;

Synchronize reception timing according to the first-type reset indication section RST1;

Start receiving one of the data sections DATA2-DATAN after triggered by one of the impulse signals SP1-SP_N−1 sent by a previous source driver; and Generate an impulse signal sent to a next source driver after finishing the data reception.

Figure 7:
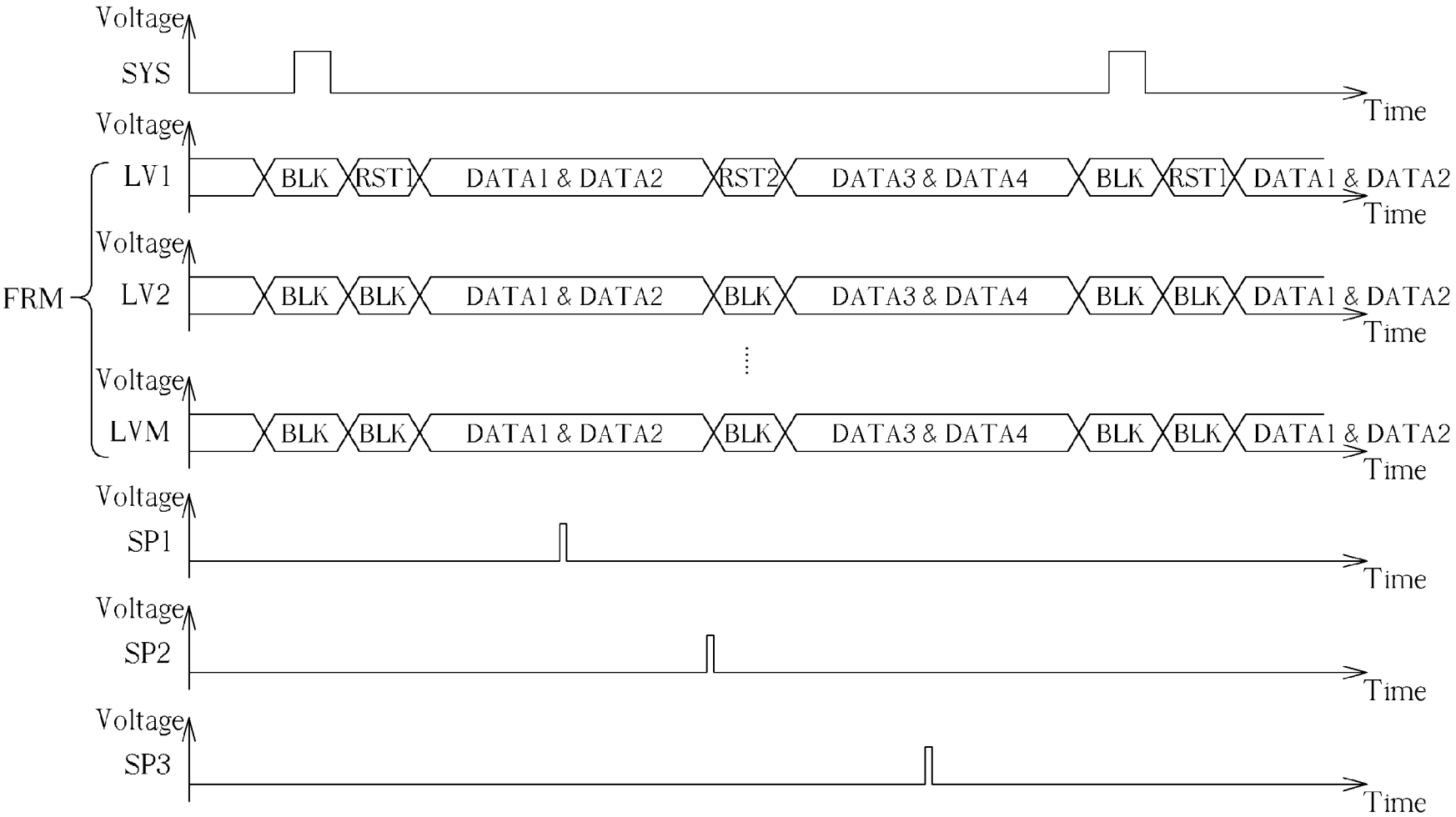
FIG. 7 is a timing diagram of an alternative embodiment of typical signals of the source driving device shown in FIG. 5.

For example, assume N=4 and the first-type cascade source drivers 520_2, 520_4 are replaced by second-type cascade source drivers. In such a situation, please refer to FIG. 7, which is a timing diagram of the system timing generation signal SYS, the frame signal FRM and the impulse signals SP1, SP2, SP3. In FIG. 7, a first source driver set includes the leading source driver 520_1 and the second-type cascade source drivers 520_2, 520_4, which are simultaneously activated by an impulse of the system timing generation signal SYS, synchronized according to the first-type reset indication section RST1, and then sequentially triggered by the impulse signals SP0 (fixed at a constant level, not drawn in FIG. 7), SP1, SP3 to one by one receive data sections DATA1, DATA2, DATA4 at different times. On the contrary, the second-type cascade source driver 520_3 receives activation from the impulse signal SP2 sent by the second-type cascade source drivers 520_2 after the previous second-type cascade source drivers 520_2 finishes receiving the data section DATA2, and then is immediately triggered by the second-type reset indication section RST2 to receive the data section DATA3. As a result, the source driver 520_3 is not activated until the source drivers 520_1, 520_2 complete data reception, and therefore this embodiment can significantly reduce power consumption in comparison with the prior art.

In other words, the frame signal FRM shown in FIG. 7 is a compromise version of the frame signals FRM shown in FIG. 2 and FIG. 6A, which can reduce power consumption while avoiding shrinking of the data sections DATA1-DATA4 due to increase of the second-type reset indication sections RST2. Therefore, through replacing the first-type cascade source drivers with the second-type cascade source drivers, the panel driving device 400 can adjust the driving process, power consumption and the frame signal FRM to meet different application requirements. In addition, the leading source driver 520_1, the first-type cascade source drivers and the second-type cascade source drivers 520_2-520_N can be identically implemented in hardware to simplify circuit design.

Note that, the timing diagram of in FIG. 7 merely illustrates one preferred embodiment, and can be modified and varied as long as the first-type cascade source drivers are sequentially triggered and the leading source driver and the second-type cascade source drivers are simultaneously activated. In addition, contents of the first-type and second-type reset indication sections RST1, RST2 can be identical or distinct to meet different application requirements.

Figure 8:
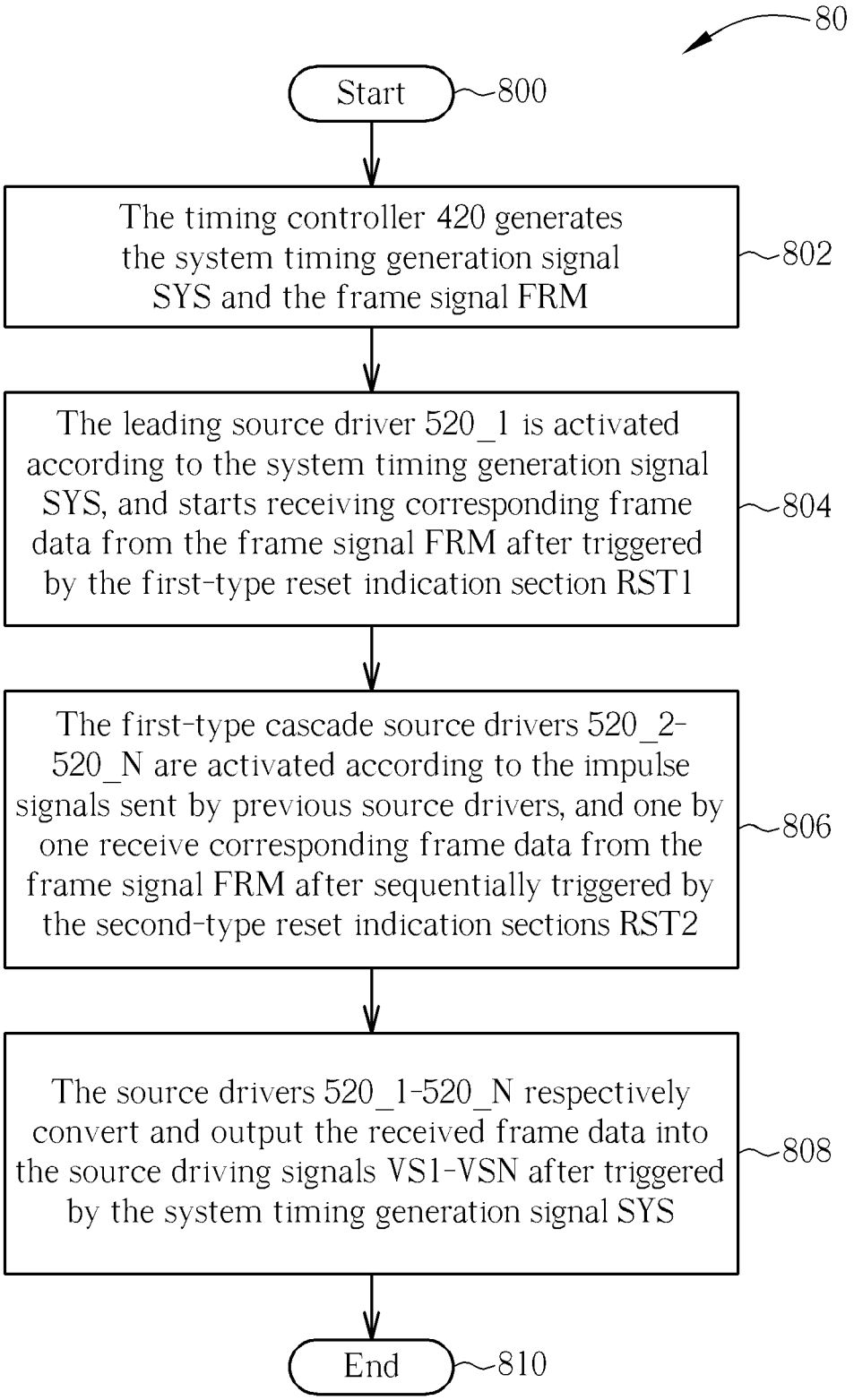
FIG. 8 is a schematic diagram of an embodiment of a driving process of the source driving device shown in FIG. 5.

Operations of the panel driving device 400 shown from FIG. 4 to FIG. 7 can be summarized into a driving process 80, as illustrated in FIG. 8. The driving process 80 includes the following steps:

Step 800: Start.

Step 802: The timing controller 420 generates the system timing generation signal SYS and the frame signal FRM.

Step 804: The leading source driver 520_1 is activated according to the system timing generation signal SYS, starts receiving corresponding frame data from the frame signal FRM after triggered by the first-type reset indication section RST1 of the frame signal FRM, and generates an impulse signal after finishing the data reception.

Step 806: The first-type cascade source drivers 520_2-520_N are activated according to the impulse signals sent by previous source drivers, one by one receive corresponding frame data from the frame signal FRM after sequentially triggered by the second-type reset indication sections RST2, and respectively generate corresponding impulse signals after finishing the data receptions.

Step 808: The source drivers 520_1-520_N respectively convert and output the received frame data into the source driving signals VS1-VSN after triggered by the system timing generation signal SYS.

Step 810: End.

Details of the driving process 80 can be referred to the above descriptions, and are not further narrated herein.

Note that, since the leading source driver 520_1, the first-type and the second-type cascade source drivers 520_2~520_N can be identically implemented in hardware, plural general source drivers may be simply implemented, so as to function as the first-type cascade source driver or the leading source driver (identical to the second-type cascade source drivers in function), thereby simplifying circuit design and adjusting power consumption and the driving process according to various application requirements.

Figure 9:
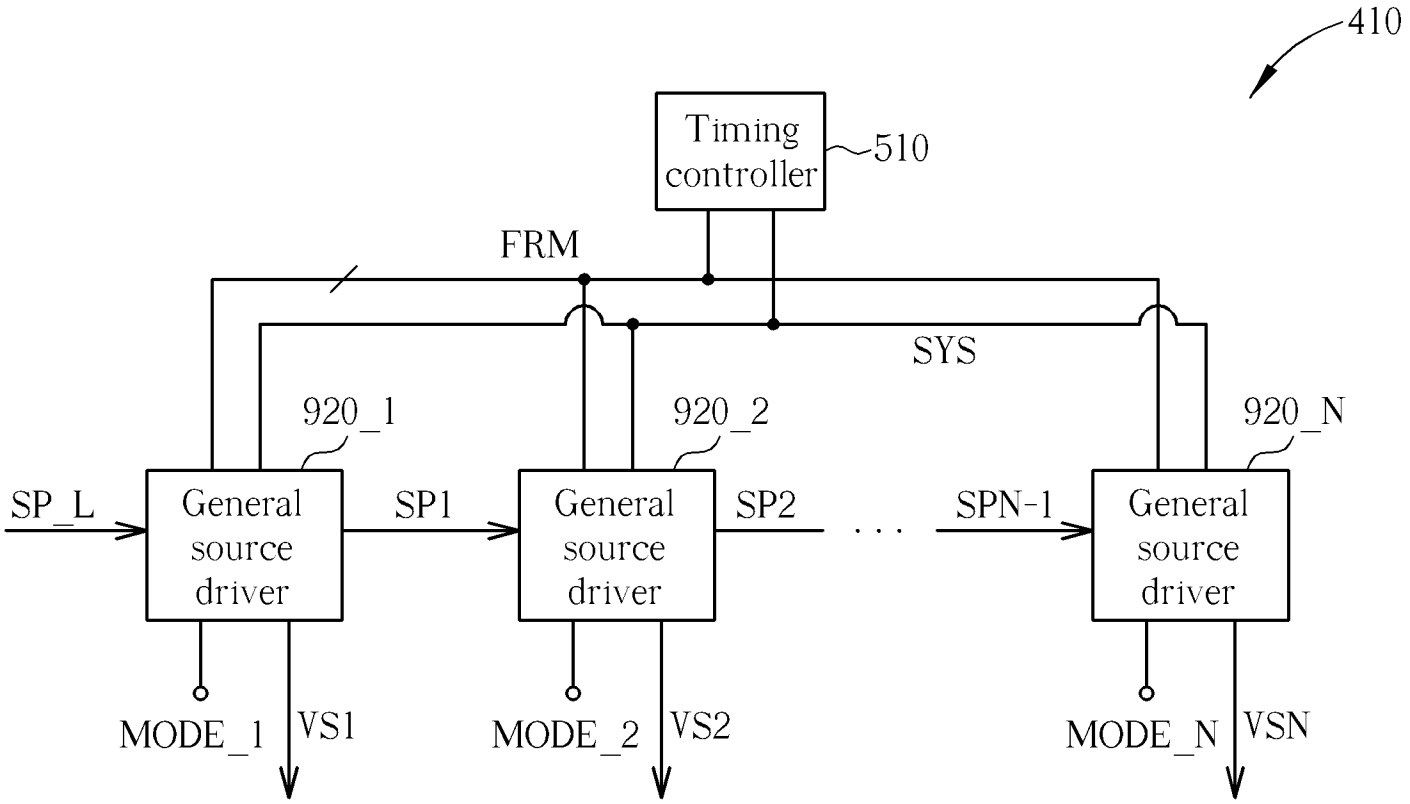
FIG. 9 is a schematic diagram of an alternative embodiment of the source driving device shown in FIG. 5.

Please refer to FIG. 9, which is a schematic diagram of an alternative embodiment of the source driving device 410. In FIG. 9, modes of plural general source drivers 920_1-920_N are switched respectively according to the mode signals MODE_1-MODE_N. Similar to the source drivers shown in FIG. 5, the general source drivers 920_1-920_N respectively includes receivers, converters and transmitters to perform data reception, conversion and transmission tasks.

If the mode signal MODE_x is configured as logic "0", the corresponding general source driver 920_*x* operates in "second mode", representing that the general source driver 920_*x* functions in a way similar to the leading source driver or as the second-type cascade source driver. Conversely, if the mode signal MODE_x is configured as logic "1", the general source driver 920_*x* operates in "first mode", representing that the general source driver 920_*x* functions as the first-type cascade source driver. For example, if the mode signal MODE_1 is configured as logic "0" and the mode signals MODE_2-MODE_N are configured as logic "1", the source driving devices shown in FIG. 9 and FIG. 5 function the same in operations.

Figure 10:
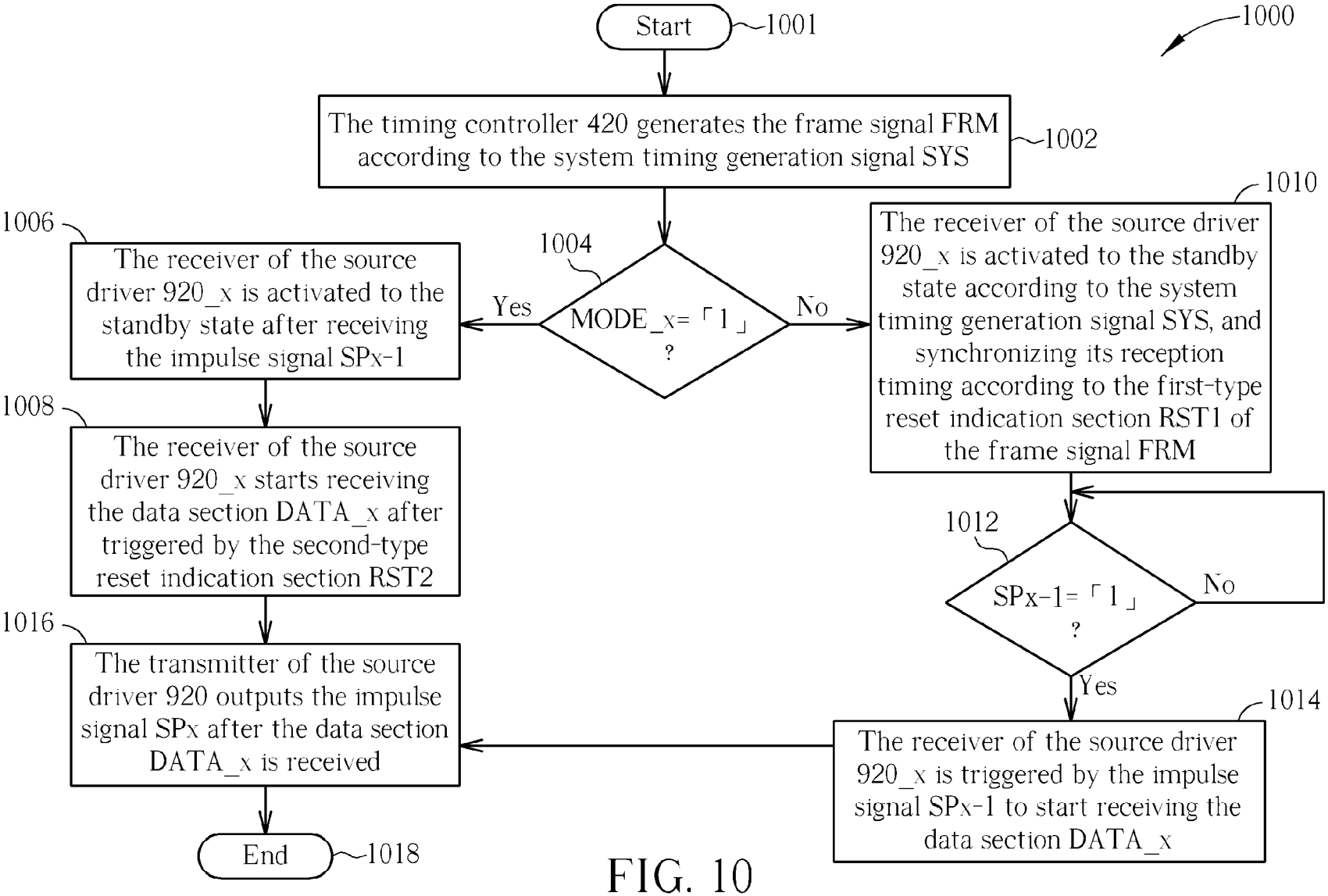
FIG. 10 is a schematic diagram of an embodiment of a control process of the source driving device shown in FIG. 9.

In detail, operations of the source driving device 410 shown in FIG. 9 can be summarized into a control process 1000, as illustrated in FIG. 10. The control process 1000 describes criterions for operation modes of the general source driver 920_*x* (x=1, 2 . . . or N), and includes the following steps:

Step 1001: Start.

Step 1002: The timing controller 420 generates, according to the system timing generation signal SYS, the frame signal FRM, which includes the first-type reset indication sections RST1, the second-type reset indication sections RST2, and blank sections BLK and data sections such as FIG. 6A.

Step 1004: Is the mode signal MODE="1"? If true, proceed to Step 1006 to operate in "first mode"; else, proceed to Step 1010 to operate in "second mode".

Step 1006: The receiver of the source driver 920_*x* is activated to the standby state after receiving the impulse signal SPx−1.

Step 1008: The receiver of the source driver 920_*x* starts receiving the data section DATA_x after triggered by the second-type reset indication section RST2. Proceed to Step 1016.

Step 1010: The receiver of the source driver 920_*x* is activated to the standby state according to the system timing generation signal SYS, and synchronizing its reception timing according to the first-type reset indication section RST1 of the frame signal FRM.

Step 1012: Is the impulse signal SPx−1="1"? If true, proceed to Step 1014; else, repeat Step 1012 till the impulse signal SPx−1="1".

Step 1014: The receiver of the source driver 920_*x* is triggered by the impulse signal SPx−1 to start receiving the data section DATA_x.

Step 1016: The transmitter of the source driver 920 outputs the impulse signal SPx (SPx: "0"→"1") after the receiver of the source driver 920 completes receiving the data section DATA_x.

Step 1018: End.

To sum up, in the prior art, the receivers are simultaneously activated according to the system timing generation SYS, but dissipate electric power without performing any function in the standby durations. Such a driving process is obviously not economical. In comparison, activation and triggering conditions for the cascade source drivers are modified and varied in above-mentioned embodiments, and correspondingly the second-type reset indication sections RST2 are inserted into the frame signal FRM to sequentially rather than simultaneously activate the source drivers, which, after the activation, are immediately triggered by previous source drivers to receive data. As a result, the standby durations as well as the power consumption are significantly reduced. In addition, through replacing one or more of the first-type cascade source drivers with the second-type cascade source drivers or switching modes of the general source drivers according the mode signals, the power consumption and the driving process of the panel driving device can be adjusted to meet different application requirements.

The activation and triggering conditions are modified and varied in above-mentioned embodiments, and accordingly triggering sections are additionally inserted in the frame signal, such that only one source driver is activated at one time, and therefore the power consumption can be reduced.

Those skilled in the art will readily observe that numerous modifications and alterations of the device and method may be made while retaining the teachings of the invention.

What is claimed is:

1. A source driving device comprising:

a plurality of source drivers, connected in series, comprising:

one or more cascade source drivers, comprising one or more first-type cascade source drivers, each first-type cascade source driver, at different times from other first-type cascade source drivers, activated from power-off to power-up to enter a standby state by a pulse signal generated by a previous source driver respectively, and triggered by a frame signal to receive corresponding frame data from the frame signal after the activation;

wherein each of the source drivers other than the last source driver, after complete of receiving the corresponding frame data, generates a pulse signal to activate the next source driver.

2. The source driving device of claim 1, wherein the plurality of source drivers further comprises a leading source driver coupled to the cascade source drivers, activated by a system timing generation signal, and after the activation, triggered by the frame signal to receive corresponding frame data from the frame signal.

3. The source driving device of claim 1, wherein the cascade source drivers further comprise one or more second-type cascade source drivers activated by a system timing generation signal, and after the activation, synchronizing reception timing according to the frame signal.

4. The source driving device of claim 3, wherein at least one of the cascade source drivers further receives a mode signal to switch to the first-type cascade source driver or the second cascade source driver.

5. A panel driving device comprising:

the source driving device of claim 1; and a timing controller, coupled to the source driving device, for generating the frame signal sent to the plurality of source drivers of the source driving device for driving the source drivers to generate a plurality of source driving signals.

6. The panel driving device of claim 5, wherein the frame signal comprises one or more differential signals, each comprising a plurality of data sections, and at least one of the differential signals respectively further comprises one or more second-type reset indication sections, each located in one of the plurality of data sections and utilized for triggering a corresponding one of the one or more first-type cascade source drivers to receive the corresponding data section.

7. The panel driving device of claim 5, wherein the plurality of source drivers further comprises a leading source driver coupled to the cascade source drivers; wherein the timing controller further generates a system timing generation signal for activating the leading source driver; and wherein the frame signal further comprises one or more differential signals, at least one of the one or more differential signals further comprising a first-type reset indication section for triggering the leading source driver to receive the corresponding frame data.

8. The panel driving device of claim 5, wherein the cascade source drivers further comprise one or more second-type cascade source drivers, each coupled to at least one of the one or more first-type cascade source drivers;

wherein the timing controller further generates a system timing generation signal for activating the one or more second-type cascade source drivers; and wherein the frame signal further comprises one or more differential signals, at least one of the one or more differential signals further comprising a first-type reset indication section for triggering the one or more second-type cascade source driver to receive the corresponding frame data.

9. The panel driving device of claim 8, wherein at least one of the cascade source drivers further receives a mode signal to switch to the first-type cascade source driver or the second cascade source driver.

10. The panel driving device of claim 5, wherein the timing controller further generates a clock signal with a time skew with respect to the frame data of the frame signal corresponding to at least one of the plurality of source drivers.

11. A display apparatus, comprising:

the panel driving device of claim 5; and a panel, for receiving driving signals from the panel driving device to display a frame.

12. The source driving device of claim 1, wherein each of the cascade source drivers is triggered by an indication section inserted in the frame signal to receive a corresponding data section in the frame signal as the corresponding frame data after the activation.

13. The source driving device of claim 1, wherein the frame signal comprises one or more differential signals, each comprising a plurality of data sections respectively corresponding to the source drivers, and at least one of the differential signals respectively further comprises one or more non-data sections, each located prior to one of the plurality of data sections.

14. The source driving device of claim 13, wherein each of the non-data section comprises at least one blank section and a reset indication section.

15. A display apparatus, comprising:

a plurality of cascade source drivers, each activated from power-off to power-up to enter a standby state by a pulse signal generated by a previous cascade source driver at different times and triggered to receive frame data after the activation; and a timing controller, for providing the frame data and after each of the cascade source driver is activated, respectively triggering the activated cascade source driver to receive the frame data, wherein each of the cascade source drivers other than the last source driver, after complete of receiving the corresponding frame data, generates the pulse signal to activate the next source cascade driver.

16. The display apparatus of claim 15, wherein each of the cascade source drivers is triggered by an indication section inserted in a frame signal generated from the timing controller to receive a corresponding data section in the frame signal as the corresponding frame data after the activation.

17. The display apparatus of claim 15, wherein a frame signal generated by the timing controller comprises one or more differential signals, each comprising a plurality of data sections respectively corresponding to the source drivers, and at least one of the differential signals respectively further comprises one or more non-data sections, each located prior to one of the plurality of data sections.

18. The display apparatus of claim 17, wherein each of the non-data section comprises at least one blank section and a reset indication section.

19. A driving method for a display apparatus, the display apparatus comprising a plurality of source drivers connected in series, the plurality of source drivers comprising one or more first-type cascade source drivers, the driving method comprising:

utilizing one or more pulse signals to sequentially activate the one or more first-type cascade source drivers from power-off to power-up to enter a standby state to respectively receive corresponding frame data from a frame signal at different times; and utilizing each of the source drivers other than the last source driver to generate one of the pulse signals after the source driver completes receiving the corresponding frame data to activate the next source driver.

20. The driving method of claim 19, wherein the frame signal comprises one or more differential signals, each comprising a plurality of data sections, and at least one of the differential signals further comprises one or more second-type reset indication sections, each located prior to one of the data sections and utilized for triggering one of the one or more cascade source drivers to receive the corresponding data section.

21. The driving method of claim 19, wherein the plurality of source drivers further comprise a leading source driver, and the driving method further comprises:

utilizing a system timing generation signal to activate the leading source driver; and utilizing the frame signal to trigger the leading source driver to receive the corresponding frame data from the frame signal.

22. The driving method of claim 19, wherein the plurality of source drivers further comprise one or more second-type cascade source drivers, and the driving method further comprises:

utilizing a system timing generation signal to simultaneously activate the one or more second-type cascade source drivers; and utilizing the frame signal to synchronize reception timings of the one or more second-type cascade source drivers.

23. The driving method of claim 19, wherein each of the source drivers is triggered by an indication section inserted in the frame signal to receive a corresponding data section in the frame signal as the corresponding frame data after the activation.

24. The driving method of claim 19, wherein the frame signal comprises one or more differential signals, each comprising a plurality of data sections respectively corresponding to the source drivers, and at least one of the differential signals respectively further comprises one or more non-data sections, each located prior to one of the plurality of data sections.

25. The driving method of claim 24, wherein each of the non-data section comprises at least one blank section and a reset indication section.

* * * * *